United States Patent [19]

Wray

[11] Patent Number: 4,767,065

[45] Date of Patent: Aug. 30, 1988

[54] MATERIAL PULVERIZING APPARATUS

[75] Inventor: Jimmy J. Wray, Macon, Ga.

[73] Assignee: JJW, Inc., Rockwall, Tex.

[21] Appl. No.: 2,645

[22] Filed: Jan. 12, 1987

[51] Int. Cl.[4] ..... B02C 7/04

[52] U.S. Cl. ..... 241/152 A; 241/247; 241/261.3; 241/296

[58] Field of Search ..... 241/46 B, 46.06, 46.08, 241/261, 261.2, 261.3, 296, 298, 246, 247, 152 A

[56] References Cited

U.S. PATENT DOCUMENTS

| | | | |
|---|---|---|---|
| 348,637 | 9/1886 | Raymond | 241/296 |
| 1,612,437 | 12/1926 | Holland-Letz | 241/296 |
| 2,819,847 | 1/1958 | Hauser . | |
| 2,824,702 | 2/1958 | Lee . | |
| 3,083,922 | 4/1963 | Enright et al. . | |
| 3,314,617 | 4/1967 | Sargood . | |
| 3,480,213 | 11/1969 | Shelton, Jr. . | |
| 4,082,229 | 4/1978 | Boosman . | |
| 4,120,457 | 10/1978 | Link . | |
| 4,134,555 | 1/1979 | Rosselet . | |
| 4,387,858 | 6/1983 | Rossler . | |

FOREIGN PATENT DOCUMENTS 1177466 9/1964 Fed. Rep. of Germany ..... 241/261

*Primary Examiner*—Mark Rosenbaum

*Attorney, Agent, or Firm*—Richards, Harris, Medlock & Andrews

[57] ABSTRACT

A pulverizing apparatus including a stator and a rotor, the rotor including a plurality of concentric rows of stairstep-like movable teeth which intermesh with a plurality of concentric rows of similar stairstep-like fixed teeth on the stator. Each tooth in the rows of intermeshing teeth defines a plurality of edges which extend across the direction of movement of the movable plate, thereby defining a plurality of openings between the fixed teeth and the movable teeth which vary in size and shape as the movable teeth move relative to the fixed teeth, to break down substances introduced into the openings. The apparatus is suitable for comminuting organic waste such as food waste, as well as inorganic material such as metal ore.

20 Claims, 4 Drawing Sheets

MATERIAL PULVERIZING APPARATUS

TECHNICAL FIELD

The present invention relates generally to an apparatus for pulverizing materials, and more particularly relates to an apparatus for the comminution or liquification of organic waste or the pulverization of inorganic substances such as minerals.

BACKGROUND ART

There are many industrial applications for devices which pulverize organic materials such as waste food products, inorganic materials such as mineral ore, and the like. As regards organic waste materials, the advancement of modern society has brought with it the problem of disposal of its wastes. A particular problem has been experienced with the disposal of solid wastes remaining following the processing of food, both at food processing plants and at large institutional kitchens. Significant health and environmental hazards can arise from the use of "dumpsters" and solid waste landfills, since such disposal devices tend to attract pests such as rodents and insects, as well as causing foul odors.

It has been found that food wastes can be disposed of more efficiently or even recycled as animal food or the like if the waste is comminuted into the form of a liquified colloidal suspension. To that end, various comminuting devices have been developed. These devices range from the common household garbage disposal in the kitchen sink to large industrial units. For example, U.S. Pat. No. 4,120,457 discloses a pulverizer employing a pivotally mounted hammer on a horizontally rotating plate which operates in relation to a fixed cylindrical surface of variable height lands and grooves, and thereafter, the food is passed between horizontally arranged and relatively rotating sets of lands and grooves mounted in complementary fashion or annular extensions of the rotating plate and the fixed housing.

In many comminuting devices, rotating members such as teeth or lands pass in close proximity to fixed members so that food pieces are caught between corners or edges of the two members and are shredded or broken apart. U.S. Pat. Nos. 4,387,858; 2,824,702; 4,082,229; 3,480,213; and 3,314,617 show shuch shredding members in comminuting units. In other such units, the rotating lands or teeth have been provided with a somewhat stepped shape surface, generally oriented to face the stationary members. Such devices are disclosed in U.S. Pat. Nos. 3,083,922; 2,819,847; and 4,134,555.

Despite these attempts, comminuting technology prior to the present invention has not reduced food wastes to liquified colloidal form as efficiently or completely as possible.

Another area in which there is a need for efficient and effective material pulverization is in the processing of metal ores, for example, iron ore.

Metallic ores such as gold, silver or copper are normally found on or near the surface of the ground in a fairly pure state; therefore, little processing is necessary. Iron ore, on the other hand, is found embedded in the earth and must be extracted from the soil and surrounding rock before it can be used productively.

The procedure used to separate iron ore from its surrounding impurities typically involves mining the ore, usually from an open pit, crushing the ore into fragments, and magnetically separating the ore fragments from the fragments of solid and rock.

It has become evident that the iron deposits in the United States are no longer yielding as much purified iron per ton. This is due to the fact that the remaining ore deposits contain a lower percentage of iron. A more efficient method of iron ore extraction is therefore needed. Pulverization of the ore into smaller particles would provide for a greater recovery of these lower amounts of iron. Therefore, an apparatus is needed which can efficiently and economically pulverize ore into very fine particles.

SUMMARY OF THE INVENTION

The present invention provides an improved comminuting apparatus capable of efficiently reducing nonhomogenous organic and inorganic materials into fine particles.

Generally described, the present invention is an improvement in a comminuting apparatus including a stationary plate, a movable plate mounted adjacent to the stationary plate, projection means extending from the stationary plate for comminuting material between the plates, and means for introducing material between the plates. One improvement is in the projection means which comprise a row of first teeth extending from the stationary plate and a row of second teeth extending from the movable plate, the rows of teeth sliding closely adjacent to one another during movement of the movable plate. Each tooth of the rows define a plurality of edges defined by surfaces extending across the direction of motion of said movable plate, the edges being defined in a side of the tooth facing the next adjacent tooth of the same row, and extending to the side of the same tooth which faces the adjacent row of teeth.

Thus, whereas in prior apparatus, stepped teeth "progressed" up or down radically with respect to a rotor and associated fixed members passed along the width of the steps, the present invention provides a step-like edge or edges that progress circumferentially when mounted on a rotor, and a smooth side surface of the stepped tooth, rather than the stepped side, moves past a stationary member. In the preferred embodiment, each tooth has such a stepped surface comprising a plurality of steps, so that as a moving tooth passes a fixed tooth, openings open to allow particles moving radially outwardly to pass partially from one row of teeth to the next and then close to break apart the particles. Unlike the openings created by the operation of the device shown in U.S. Pat. No. 4,120,157, the present invention provides openings of changing shape characterized by the edges described above and also by sharp corners where such edges meet the sides of the tooth facing the adjacent row of teeth. These corners and edges cut efficiently into the material to be pulverized and, when water is present, reduce the material to a finely divided colloidal suspension by the time the material has passed through successive rows of teeth.

Preferably, each tooth of each row of teeth defines a plurality of steps in one side facing a smooth side of the next tooth in the same row, and the preferred apparatus constructed according to the invention includes several circumferentially nested circular rows of said teeth mounted alternately on a rotor and a stator. The apparatus can include a rasp means at the center of the rows for initially breaking up large portions of the material before it moves radially outwardly between the rotor and stator. At the periphery of the rotor, the pulverized material is forced into an exit pipe which extends outwardly at an angle slightly more than ninety degrees to a radius of the rotor, and empties into a reservoir from which the material can be removed for disposal or further processing.

One particular advantage provided in the present invention is that the physical mechanism does not depend on cutting of the material by the teeth. Rather, it is believed that centrifugal force plays a major role in the breakdown of particles in the present invention. The high speed of rotation causes particles introduced into the apparatus to accelerate radially outwardly. The intermeshing teeth of each row or "stage" of teeth present a variable sized radial opening to a next radially positioned row or stage. A given particle may find itself presented with an opening large enough to pass through to the next stage, or it may encounter a "wall" or small opening, which does not permit unobstructed passage to the particle. The particle then under centrifugal force impacts the "wall" or small opening and is decelerated rapidly. The force of impact is believed to contribute significantly to particle breakdown.

Comminution of organic or inorganic substance in an apparatus according to the invention raises the temperature of the substance from ambient temperature to over 121 degrees Celsius, depending upon the characteristics of the substance. If the substance is an organic waste, then the elevation in temperature effectively kills large numbers of the bacteria present in the waste. This reduction in the amount of bacteria reduces the health hazards and odors normally associated with organic waste.

Thus it is an object of the present invention to provide an improved comminuting apparatus.

It is another object of the present invention to provide a comminuting apparatus which reduces non-homogenous organic waste to a finely divided liquified colloidal suspension in an efficient manner.

It is another object of the present invention to provide a comminuting apparatus which significantly raises the temperature of waste being liquified.

It is another object of the present invention to provide a pulverizing apparatus which reduces ore into a finely particulate substance.

Other objects, features and advantages of the present invention will become apparent upon review of the following description of an embodiment of the invention and the appended drawing.

DETAILED DESCRIPTION OF THE PREFERRED EMBODIMENT

Figure 1:
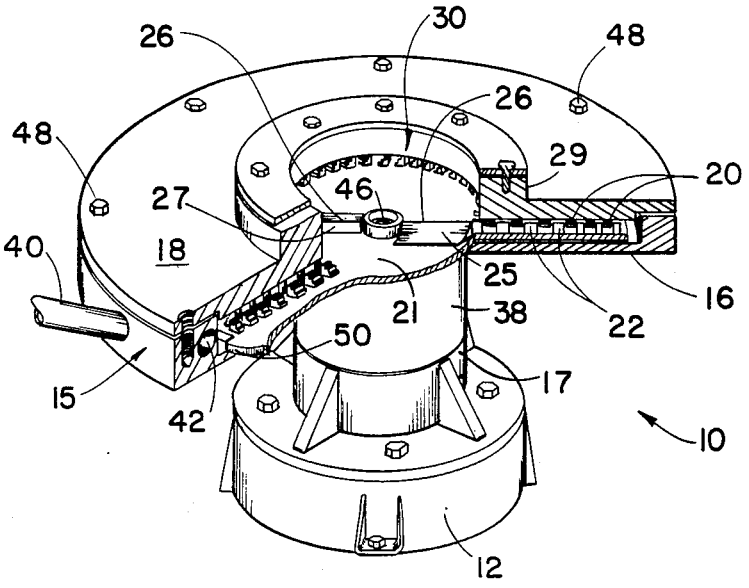
FIG. 1 is a pictorial view of a preferred embodiment of the present invention, in assembled form and with portions cut away to show interior detail.
Figure 2:
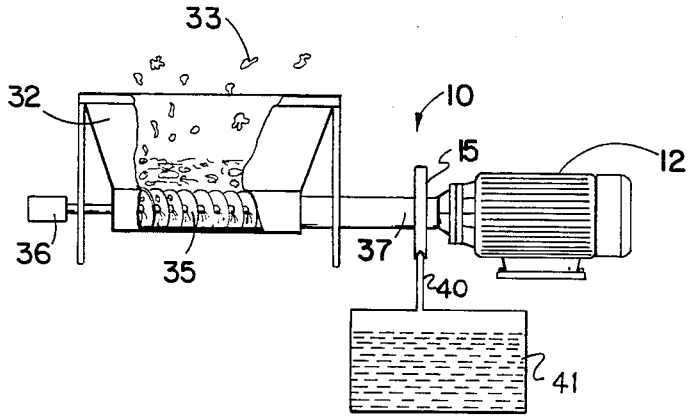
FIG. 2 is a diagrammatic view of a material processing system including the preferred embodiment of the comminuting apparatus of the present invention.
Figure 3:
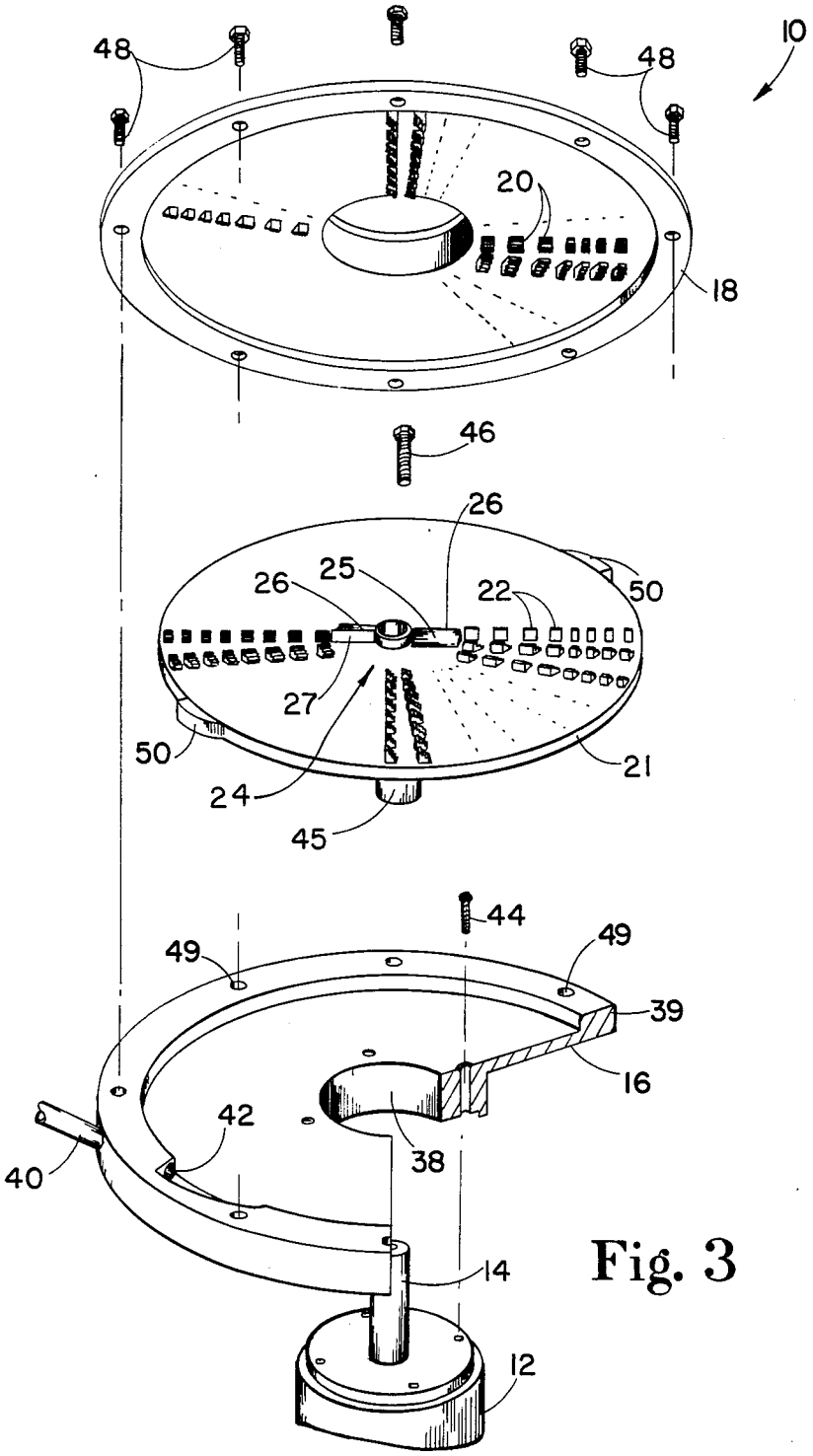
FIG. 3 is an exploded view of the embodiment of FIG. 1.

Referring now to the drawings, in which like numerals refer to like parts throughout the several views, FIG. 1 shows a pictorial view of a comminuting apparatus 10 constructed according to the present invention. A section of the apparatus 10 has been removed to show interior detail. FIG. 3 shows an exploded pictorial view of the comminuting apparatus 10 constructed according to the present invention. An electric motor 12 is provided for driving the apparatus 10 and includes a drive shaft 14 positioned along the axis of the apparatus 10. The comminuting apparatus 10 includes a housing 15 comprising a lower housing base 16 attached to a motor mount 17, and an upper housing cover 18. The cover 18 serves as a stator carrying concentric rows of teeth 20, described in greater detail below. A rotor 21 is moutned on the end of the drive shaft 14 and carries concentric rows of teeth 22. The rotor 21 fits between the lower and upper housing components 16 and 18 in a manner shown in FIGS. 2 and 4, with the rows of teeth 22 on the rotor 21 being matingly received between the rows of teeth 20 on the stator 18.

Figure 4:
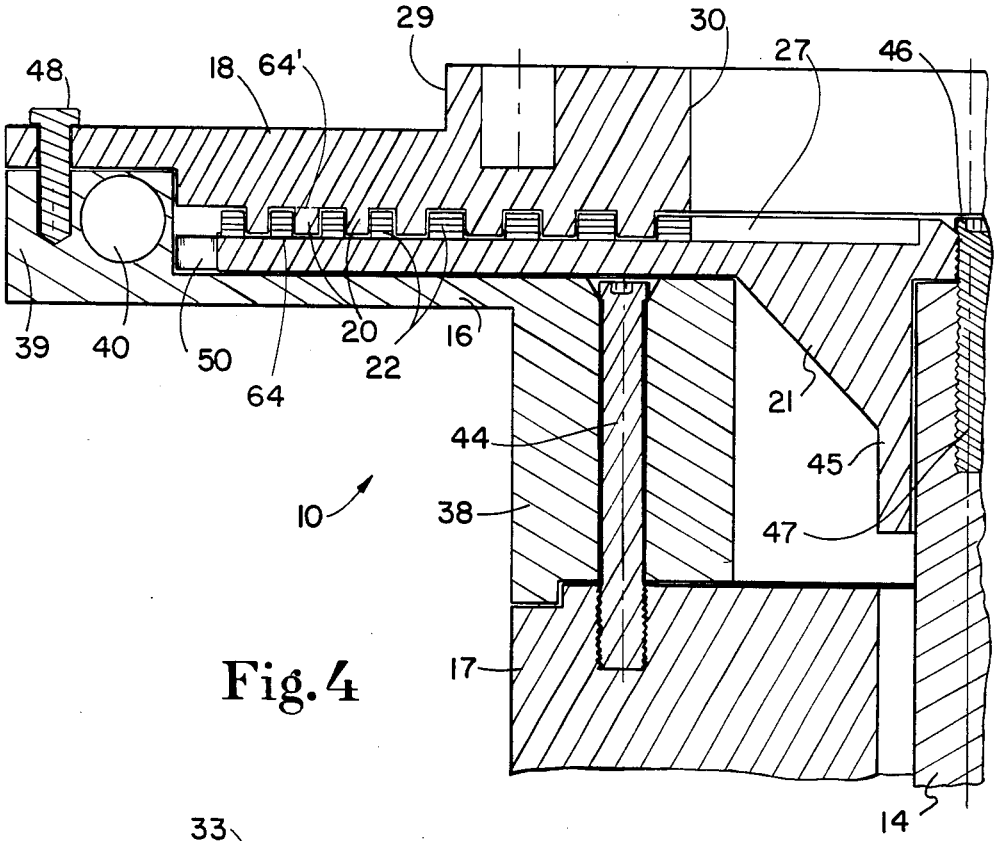
FIG. 4 is a partial axial cross sectional view taken along line 4—4 of FIG. 1.

At the center of the rotor 21 a rasp 24 is formed. The rasp 24 comprises a pair of semi-circular ramps 25 sloping upwardly from the surface of the rotor to form radial cutting edges 26 between the ramps 25 and edges 27. The stator 18 defines an axially outwardly extending annular throat 29 which in turn defines an opening 30 for receiving material and directing it to the rasp 24, as seen in FIGS. 2 and 4. Material being fed into the opening 30 of the throat 29 initially engages the rasp 24 and is broken down into pieces sufficiently small to be engaged by the rotor 21 and stator 18.

Referring now to FIG. 2, non-homogeneous material 33 is placed into a hopper 32. The bottom of the hopper 32 guides the material 33 into an auger conveyor 35 driven by a motor 36 in a conventional manner. As the material is augured through the conveyor 35 it is mixed and partially broken down. The material passes through a conduit 37 into the opening 30 of the apparatus 10.

The housing base 16 defines an annular throat 38 which extends axially outwardly toward the motor mount 17, as best shown in FIG. 4. FIG. 4 is a cross sectional view of one half of the comminuting apparatus 10, the other half being the mirror image of the portion shown (except for the exit pipe 40, described below). The housing base 16 also defines an annular rim 39 at the periphery of the base 16 extending toward the stator 18 and maintaining the stator 18 in spaced apart relation from the base 16. The space thus created between the base and stator receives the rotor 21. A cutout 42 (FIG. 3) is formed in the rim 39 opening inwardly. From the cutout 42 an exit pipe 40 extends through the rim 39 to the outside of the housing 15. In embodiments wherein a liquid suspension of material is involved, the pipe 40 must be positioned at an angle slightly divergent from a tangent to the rim 39. In order to effectively carry away liquified material from between the rotor and stator, the pipe 40 should preferably extend outwardly at an angle to a radius of the rotor passing through the cutout 42 of slightly more than ninety degrees.

As shown in FIG. 2, the exit pipe 40 leads to a reservoir 41 from which the liquified material can be removed for disposal or further processing. In the preferred embodiment for processing food waste, the reservoir 41 is maintained airtight to preserve sanitation.

The apparatus 10 is assembled first by connecting the throat 38 of the base 16 to the motor mount 17 by means of countersunk bolts 44 as shown in FIG. 4. Oil seals (not shown) meeting U.S. Food and Drug Administration standards are installed on the shaft 14 to isolate the motor from the processing portions of the apparatus. The rotor 21 defines a throat 45 extending toward the motor mount at the center of the rotor, and the throat 45 receives the extending end of the drive shaft 14. A countersunk bolt 46 is screwed into a threaded bore 47 in the end of the shaft 14 to firmly attach the shaft 14 in the end of the shaft 14 to the rotor 21. The length of the shaft 14 is selected so that the rotor will lie closely adjacent to the base 16 without binding during rotation of the rotor. The stator 18 is then attached directly to the base 16 by means of bolts 48, which are received in threaded bores 49 in one of the members. The conduit 37 leading from the auger 35 can be attached to communicate with the opening 30 in a conventional manner.

In the assembled configuration shown in FIG. 4, it can be seen that the rows of teeth 20 and 22 of the stator 18 and rotor 21, respectively, are brought into close fitting mating relationship with each circular row of teeth of the rotor 21 extending to fill the annular space between adjacent concentric rows of teeth of the stator 18. The radial dimension of the teeth gradually decreases from the center of the apparatus to the outer periphery.

A pair of wiper blades 50 are attached to the periphery of the rotor 21 on opposite sides of the rotor. The wiper blades fill the annular space between the edge of the rotor and the rim 39 of the base 16. The wiper blades 50 press against the interior rim 39 when the rotor is assembled, and push comminuted material exiting from between the stator and rotor into the cutout 42 and out through the pipe 40. As viewed in FIG. 3, the rotor rotates in a clockwise direction. The wiper blades 50 are preferably made of steel.

Figure 5:
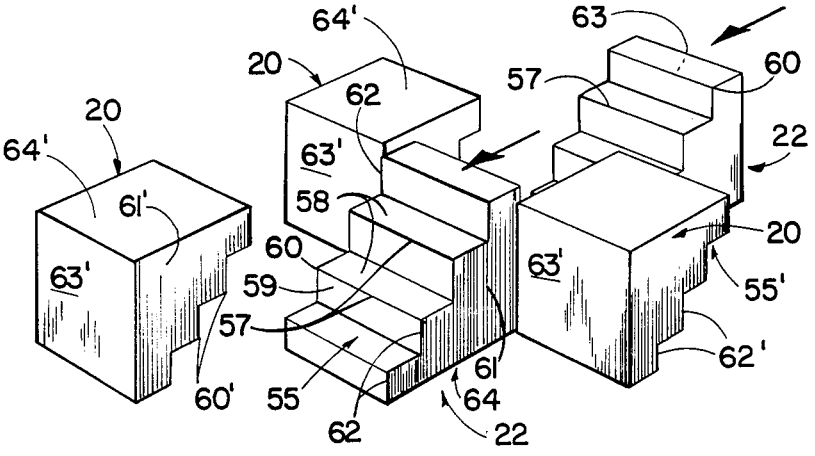
FIG. 5 is an enlarged view of plurality of teeth during operation of the preferred embodiment of the present invention, with the rotor and stator plates removed for clarity.

The construction of the teeth 20 and 22 is shown in detail in FIG. 5. Each tooth 22 on the rotor 21 defines a set of steps 55 facing in the direction of travel of the tooth as shown by an arrow in FIG. 5. The steps 55 "ascend" from a base 64 of the tooth, the base 64 being integrally connected to the rotor 21, as shown in FIG. 4. The steps form radially extending surfaces on the tooth by a plurality of parallel edges 57 defined by intersection of a horizontal surface 58 and a vertical surface 59. Each tooth 22 includes a pair of vertical side surfaces 61 which pass closely adjacent to corresponding side surfaces 61' of the teeth 20 of the adjacent rows of the stator 18. Where the edges 57 meet the side surfaces 61, corners or points 60 are formed. The steps 55 and corners 60 are important in the operation of the apparatus 10 as described below. The fourth side surface of each tooth 22 is a flat trailing radial surface 63 which faces away from the direction of travel of the tooth. Of course, the terms "horizontal" and "vertical" are used herein only to provide a relative frame of reference, since the apparatus 10 can be positioned and operated in any orientation with respect to the vertical.

The stator teeth 20 are formed similarly to the teeth 22, but include steps 55' facing in an opposite direction to the step 55 of the teeth 22, and "descending" from a base 64' integrally connected to the stator 18. The steps 55' define edges 57' like the edges 57, corners 60', and surfaces 63' opposite the steps 55'.

In operation of the comminuting apparatus 10, nonhomogenous material 33 is loaded into the hopper 32 and augured by the auger 35 into the conduit 37. The action of the auger 35 initially mixed and begins to break down the material. From the conduit 37 the material, which may be in the form of a slurry, enters the opening 30 for introduction into the comminuting apparatus 10. When processing organic material such as food waste, the material becomes a slurry because such waste naturally contains a large amount of liquid. Likewise, inorganic ores are often found in wet environments. If the organic material is dry, then water can be added before operation of the comminuting apparatus 10 commences. The slurry is forced by the action of the auger into the rasp 24 which further breaks down the material by the action of the cutting edges 26. Pieces and bits of the material then are forced outwardly by centrifugal force between the stator 18 and the rotating rotor 21, which should be set in motion by activating the motor 12 prior to initial operation of the auger 35. The rotor 21 is preferably rotated at about 3600 RPM.

The particles of material also begin to be slung outwardly by the motion of the rotor 21. Such particles encounter a series of irregular openings 65 (FIG. 6A–6F) of variable and changing size formed by the alternating rows of stator and rotor teeth 20 and 22 as they move relative to each other. The variation in the openings 65 is shown diagrammatically in FIGS. 6A–6F, which portray a representative row of rotor teeth 22 moving in the direction of the arrow, and the next outwardly adjacent row of stator teeth 20, viewed radially outwardly from the center of the rotor 21. In the initial position shown in FIG. 6A, the "ascending" steps 55 of the teeth 22 are aligned radially with the "descending" steps 55' of the teeth 20, momentarily closing off the openings 65.

Figure 6A:
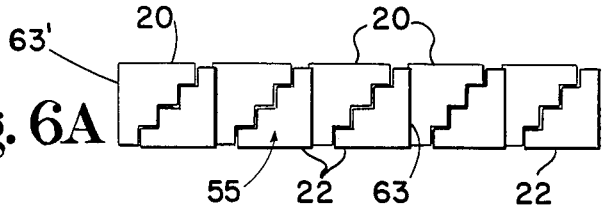
FIGS. 6A–6F are a series of diagrammatic representations showing successive positions of teeth of adjacent rows during operation of the preferred embodiment of the invention.
Figure 6B:
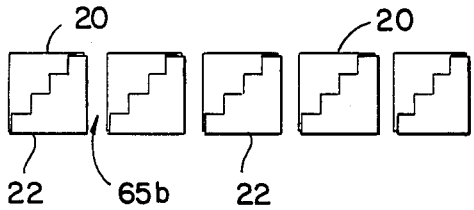
Figure 6C:
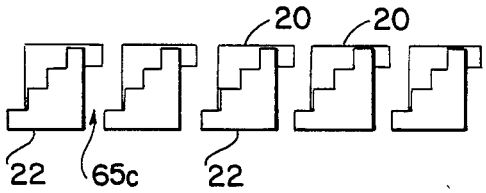
Figure 6D:
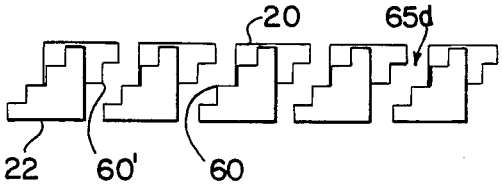

In FIG. 6B, the rotor teeth have moved a distance about equal to the depth of one step, creating a rectangular opening **65*b*. In FIG. 6C, after moving a similar distance, the opening 65*c* begins to assume an irregular, somewhat diagonal shape as the extreme steps of each tooth protrude into the opening. In FIG. 6D, the steps 55 and 55' of teeth in adjacent rows begin to close off the opening 65*d* and trap between their teeth 22 and 20** any particles attempting to pass radially outwardly between the rows of teeth.

Figure 6E:
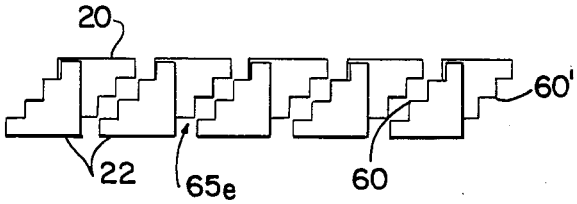

In FIG. 6E, the edges 57 and 57' are radially aligned and the corners 60 and 60' are essentially touching. The corners 60 and 60' act to pierce into the particles now trapped between the teeth 22 and 20. Following the corners, the edges 57 and 57' press upon the material, as do the edges 62 and 62', which pass in close proximity in FIG. 6F, breaking apart a trapped particle.

It is believed that the particles break apart primarily because of the impact forces of the particle against the partially closed opening; however, the slicing, tearing or cutting forces of the closing teeth 22 and 20 may also contribute to the pulverization process. These impact forces result from the centrifugal forces generated by the high speed of rotation of the rotor. As will be appreciated by those skilled in the art, the intermeshing teeth of each row or "stage" of teeth present variable sized and shaped radial openings **65*b*, 65*c*, 65*d*, 65*e* to a next radially positioned row or stage, depending upon the position of the rotor with respect to the stator. A given particle may find itself presented with an opening large enough to pass through to the next stage, such at 65*c*, or it may encounter a "wall" or small opening such as 65*e*** which does not permit unobstructed passage to the particle. The particle then at high speed, as a result of centrifugal force, impacts the "wall" or small opening, and is decelerated rapidly. Portions of the particle in the center of the particle may break free and continue radial movement, while portions impacting the small opening may lodge thereupon, to be met soon thereafter by the meshing teeth. Accordingly, and in addition to the cutting operation of the teeth, the force of impact is believed to contribute significantly to particle breakdown.

It is believed that the advantages of operation provided in the present invention are due primarily to the presentation of opening and closing "holes" to material being processed. Accordingly, it should be understood that other tooth configurations which provide such dynamically varying sized openings are considered within the scope of the present invention. For example, the preferred embodiment possesses teeth which are configured in "steps". Other embodiments include tooth configurations wherein the operative sides of the teeth are linearly or curvilinearly smooth, extending from the base of the stator or rotor to the crown of the tooth. Other embodiments would include tooth configurations which have more or fewer steps, or where the steps are differently sized. Yet other configurations include the provision of teeth which gradually increase in thickness moving radially outwardly, contrasted with the disclosed embodiment wherein the tooth thickness gradually decreases moving radially outwardly. Yet still other configurations include different shapes for the teeth, for example pyramidal teeth, or frustoconical teeth, or parallelopipedal teeth. The important consideration is that the movement of the teeth relative to one another provides a dynamically varying sized opening.

Figure 6F:
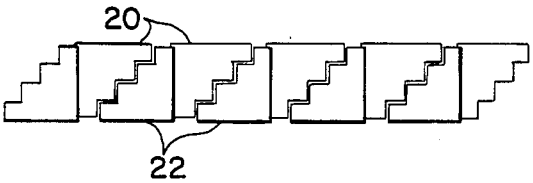

It will be apprecaited that the "shape" of the openings 65 varies from a rectangular, to somewhat diagonally offset at the top and bottom of the opening (FIG. 6C), to a wide stepped diagonal shape (FIG. 6D), to narrow stepped diagonal shape (FIG. 6E), to closed (FIGS. 6A, 6F).

It will be seen that the initial configuration is repeated in FIG. 6F, and that the sequence just described repeats itself innumerable times as the rotor teeth of each row move rapidly past the stator teeth. Each particle of material passing between the stator and the rotor must pass through a very large number of openings 65 between the rasp 24 and the periphery of the rotor which vary in geometry, shape, and size as the teeth of the stator and rotor move relative to each other.

Moving rapidly outwardly from the opening 30 to the periphery of the rotor 21, the teeth of both the rotor and stator gradually decrease in radial thickness, as best illsutrated in FIG. 4, in order to provide the greatest strength for the teeth when the particles of material are large and to provide fineness when the particles have been pulverized and to adjust the dimensions and distances travelled to the ever decreasing size of the particles. By the time the material emerges from between the stator and rotor and is swept by one of the wipers 50 into the exit pipe 40, the material has been reduced to a liquified colloidal suspension.

The continuous and repetitive action of the teeth 20 and 22 on the material also raises the temperature of the material being pulverized from ambient temperature to about over 121 degrees Celsius, which is sufficiently high to kill bacteria present in waste and therefore sanitize the slurry. This temperature increase is believed to result from friction and from the breakdown of fibers in the waste.

Thus, it will be appreciated that the present invention provides an improved comminuting device including an arrangement of unique teeth which interact to efficiently break down a non-homogeneous mixture of organic or inorganic materials into a heated, finely divided colloidal suspension suitable for disposal or further processing.

While this invention has been described in detail with particular reference to a preferred embodiment thereof, it will be understood that variation and modifications can be effected within the spirit and scope of the invention as described hereinbefore and as defined in the appended claims.

I claim:

1. In a comminuting apparatus including a stationary plate, a movable plate mounted adjacent to said stationary plate and movable in a first direction relative to said stationary plate, projection means extending from said stationary plate toward said movable plate and from said movable plate toward said stationary plate for comminuting material between said plates, and means for introducing material between said plates, the improvement wherein said projection means comprises:

a row of first teeth extending from said stationary plate and a row of second teeth extending from said movable plate, said rows of teeth sliding closely adjacent to one another during movement of said movable plate in the first direction, each tooth of said rows defining a first face, the first faces on the row of second teeth facing the first faces on the row of first teeth as the movable plate moves in the first direction, the first faces of at least one of said rows of teeth defining a plurality of edges defined by intersection stepped surfaces which extend perpendicular to the first direction of movement of said movable plate.

2. The apparatus of claim 1, wherein said surfaces defining said edges meet at right angles and define a plurality of steps in said teeth of said one of said rows.

3. The apparatus of claim 1, wherein said edges extend radially to another said tooth which faces said other row of teeth.

4. The apparatus of claim 1, wherein said rows of teeth are concentric.

5. The apparatus of claim 1, wherein said edges are substantially parallel.

6. The apparatus of claim 1, wherein each tooth of said one of said rows further defines a flat side opposite to said first face which includes said edges, said flat side extending at right angles to the direction of motion of said movable plate.

7. The apparatus of claim 1, wherein said teeth in both of said rows define said edges.

8. The apparatus of claim 1, further comprising a plurality of said rows of said first teeth and a plurality of said rows of said second teeth.

9. The apparatus of claim 1, wherein said rows of first and second teeth comprise concentric circular rows of said teeth, and wherein said movable plate comprises a rotor mounted for rotation about an axis through the center of said circular rows of teeth.

10. The apparatus of claim 9, wherein said means for introducing material comprises means at the center of said rotor for introducing material between said plates.

11. The apparatus of claim 10, further comprising rasp means associated with said means for introducing material, for breaking up said material prior to introduction thereof between said plates.

12. The apparatus of claim 1, wherein the apparatus is employed for comminuting organic material.

13. The apparatus of claim 12, wherein the organic material is food waste.

14. The apparatus of claim 1, wherein the apparatus is employed for reducing inorganic material.

15. The apparatus of claim 14, wherein the inorganic material is a metal ore.

16. In a comminuting apparatus including a circular stator plate, a rotor plate rotatably mounted adjacent to said stator, a central opening through which material is introduced between said stator and said rotor, and projection means extending from said stator toward said rotor and from said rotor toward said stator for comminuting material introduced between said stator and said rotor, the improvement wherein said projection means comprises:

a plurality of concentric rows of teeth extending from said stator, the teeth in each of said rows being spaced apart circumferentially from one another, and each of said stator teeth comprising a stepped radially extending surface, all of said stepped radially extending surfaces of said stator teeth being inclined from a base of said tooth to a peripheral surface of said tooth narrower than said base and facing in the same rotational direction; and a plurality of concentric rows of teeth extending from said rotor, said rows of rotor teeth fitting between said rows of stator teeth, each of said rotor teeth being spaced apart circumferentially from teeth in the same row, and each of said rotor teeth comprising a stepped radially extending surface, all of said stepped radially extending surfaces of said rotor teeth being inclined from a base of said tooth to a peripheral surface of said tooth wider than said base and facing in a rotational direction opposite to the stepped radially extending surfaces of said stator teeth.

17. In a comminuting apparatus including a circular stator plate, a rotor plate rotatably mounted adjacent to said stator, a central opening through which material is introduced between said stator and said rotor, and projection means extending from said stator and said rotor and from said rotor toward said stator for comminuting said material introduced between said stator and rotor, the improvement wherein said projection means comprises:

a plurality of concentric rows of teeth extending from said rotor, the teeth in each of said rows being spaced apart circumferentially from one another, and each of said rotor teeth comprising a flat radial surface and a stepped radial surface, all of said stepped radial surfaces of said rotor teeth being inclined from a base of said tooth to a peripheral surface of said tooth narrower than said base and facing in the same rotational direction; and a plurality of concentric rows of teeth extending from said stator, said rows of stator teeth fitting between said rows of rotor teeth, each of said stator teeth being spaced apart circumferentially from teeth in the same row, and each of said stator teeth comprising a flat radial surface and a stepped radial surface, all of said stepped radial surfaces of said stator teeth being inclined from a base of said tooth to a peripheral surface of said tooth wider than said base and facing in a direction opposite to the stepped radial surface of said rotor teeth.

18. A pulverizing apparatus, comprising:

a plurality of fixed teeth lying generally in a first plane;

a plurality of movable teeth lying generally in the first plane and movable closely adjacent to said fixed teeth;

means for moving said movable teeth relative to said fixed teeth in a first direction;

said fixed teeth and said movable teeth each defining first faces, the first faces of the fixed teeth facing the oncoming first faces of the movable teeth as said movable teeth move in the first direction, each of the first faces defining a plurality of intersecting surfaces, each surface extending perpendicular the first direction so that when a given movable tooth moves toward a given fixed tooth, the opening between the first faces of the given teeth viewed perpendicular the first direction and in the first plane varies in size and shape as said movable teeth move relative to said fixed teeth, to break down material introduced into said openings;

means for introducing material to be pulverized into said openings.

19. The apparatus of claim 18, wherein the edges of said fixed teeth and said movable teeth define the openings therebetween and impact the material to cause the comminution of the material as the material periodically encounters openings having varying degrees of partial closure.

20. The apparatus of claim 18, wherein the shape of said openings varies from substantially rectangular, to diagonally offset, and to diagonally stepped.

* * * * *